US010823199B2

(12) United States Patent
Jones

(10) Patent No.: US 10,823,199 B2
(45) Date of Patent: Nov. 3, 2020

(54) GALVANIC CORROSION RESISTANT COATING COMPOSITION AND METHODS FOR FORMING THE SAME

(71) Applicant: General Electric Company, Schenectady, NY (US)

(72) Inventor: Scott Allen Jones, Durham, NC (US)

(73) Assignee: General Electric Company, Schenectady, NY (US)

( * ) Notice: Subject to any disclaimer, the term of this patent is extended or adjusted under 35 U.S.C. 154(b) by 284 days.

(21) Appl. No.: 15/493,719

(22) Filed: Apr. 21, 2017

(65) Prior Publication Data

US 2018/0328383 A1 Nov. 15, 2018

Related U.S. Application Data

(60) Provisional application No. 62/374,335, filed on Aug. 12, 2016.

(51) Int. Cl.

| | |
|---|---|
| ***F04D 29/52*** | (2006.01) |
| ***F04D 29/02*** | (2006.01) |
| ***F01D 25/24*** | (2006.01) |
| ***F01D 11/12*** | (2006.01) |

(52) U.S. Cl.

CPC ..... *F04D 29/526* (2013.01); *F01D 11/122* (2013.01); *F01D 25/24* (2013.01); *F04D 29/023* (2013.01); *F05D 2220/323* (2013.01); *F05D 2230/312* (2013.01); *F05D 2230/90* (2013.01); *F05D 2260/95* (2013.01); *F05D 2300/173* (2013.01); *F05D 2300/522* (2013.01); *F05D 2300/611* (2013.01)

(58) Field of Classification Search

CPC ..... F04D 29/526; F04D 29/023; F01D 11/00; F01D 11/08; F01D 11/12; F01D 11/122; F01D 25/24

See application file for complete search history.

(56) References Cited

U.S. PATENT DOCUMENTS

| | | | | |
|---|---|---|---|---|
| 2,788,290 | A | 4/1957 | Deuble | |
| 2,857,297 | A | 10/1958 | Moore et al. | |
| 3,586,614 | A | 6/1971 | Boggs | |
| 5,650,235 | A | 7/1997 | McMordie et al. | |
| 5,705,231 | A * | 1/1998 | Nissley | C23C 4/02 427/453 |
| 5,795,659 | A | 8/1998 | Meelu et al. | |
| 5,873,951 | A | 2/1999 | Wynns et al. | |
| 6,089,825 | A * | 7/2000 | Walden | C23C 4/04 415/173.4 |
| 6,358,002 | B1 * | 3/2002 | Good | F01D 11/122 415/174.4 |

(Continued)

*Primary Examiner* — Richard A Edgar

(74) *Attorney, Agent, or Firm* — Dority & Manning, P.A.

(57) ABSTRACT

Coating systems for components of a gas turbine engine, such as a compressor case, are provided. The coating system can include a dense layer disposed along the inner surface of the compressor case as well as an abradable, top coat disposed along the dense layer. The combination of dense layer and abradable top coat can reduce the occurrence of galvanic corrosion of the coating system and thereby increase the lifetime of the coating system and preserve blade clearances within the compressor. Methods are also provided for applying the coating system onto a compressor case.

14 Claims, 5 Drawing Sheets

(56) References Cited

U.S. PATENT DOCUMENTS

| | | | | |
|---|---|---|---|---|
| 6,652,227 | B2 * | 11/2003 | Fried | F01D 11/122 415/173.4 |
| 7,157,151 | B2 | 1/2007 | Creech et al. | |
| 7,879,459 | B2 | 2/2011 | Freling et al. | |
| 9,703,090 | B2 * | 7/2017 | Kell | B23K 26/0096 |
| 2013/0125552 | A1 | 5/2013 | Shirooni et al. | |

* cited by examiner

GALVANIC CORROSION RESISTANT COATING COMPOSITION AND METHODS FOR FORMING THE SAME

PRIORITY INFORMATION

The present application claims priority to U.S. Provisional Patent Application Ser. No. 62/374,335 titled "Galvanic Corrosion Resistant Coating Composition and Methods for Forming the Same" filed on Aug. 12, 2016, the disclosure of which is incorporated by reference herein.

GOVERNMENT SUPPORT CLAUSE

This invention was made with government support under contract number N66001-07-C-2038 NAVY awarded by the government. The government has certain rights in this invention.

FIELD OF THE TECHNOLOGY

Embodiments of the present invention generally relate to galvanic corrosion resistant coating systems for metallic components, particularly for use on a compressor case in a gas turbine engine.

BACKGROUND

Gas turbine engines typically include a compressor for compressing air. The compressed air is mixed with a fuel and channeled to a combustor, where the mixture is ignited within a combustion chamber to generate hot combustion gases. The combustion gases are channeled to a turbine. The turbine section of a gas turbine engine contains a rotor shaft and one or more turbine stages, each having a turbine disk (or rotor) mounted or otherwise carried by the shaft and turbine blades mounted to and radially extending from the periphery of the disk. A turbine assembly typically generates rotating shaft power by expanding hot compressed gas produced by the combustion of a fuel. Gas turbine buckets or blades generally have an airfoil shape designed to convert the thermal and kinetic energy of the flow path gases into mechanical rotation of the rotor.

Engine performance and efficiency may be enhanced by reducing the space between the tip of the rotating blades and the respective casing to limit the flow of air over or around the top of the blade that would otherwise bypass the blade. For example, a compressor blade may be configured so that its tip fits close to the compressor case during engine operation. During engine operation, however, the blade tips may rub against the case, thereby increasing the gap and resulting in a loss of efficiency, or in some cases, damaging or destroying the blade set. To reduce the risk of blade loss, an abradable layer may be deposited on top of the compressor case. The abradable layer acts as a sacrificial layer that may be rubbed off by the blades during operation.

Abradable layers, particularly those found on compressor cases, are often porous layers. The porous layer has a lower modulus than more dense layers and thereby may provide a dampened blade response when rub occurs. Accordingly, external fluids such as water, in particular salt water, are able to pass through the porous, abradable layer creating issues by reacting with the coating materials. For instance, during operation of the compressor in the gas turbine engine, salt water may enter the porous, abradable layer and collect at the interface of the porous layer and the compressor case or other coating material. The external fluid, such as salt water, can thereby create an environment for galvanic corrosion due to galvanic potential differences between the porous, abradable layer and the compressor case or other coating materials.

Delamination of abradable coatings occurs with a high failure rate for engines, particularly maritime engines such as the T700 turboshaft engine by GE, and often starts with corrosion between a top, abradable coating and an underlying, bond coat at the interface of the top coat and bond coat. Delamination also seems to increase with respect to compressor stage and, thus, inversely proportional to blade clearance. Conventional top coats allow for the egress of salt water and other electrolytic solutions to the interface allowing for galvanic corrosion of the materials.

Thus, an improved design for a coating system for a compressor case is desirable in the art.

BRIEF DESCRIPTION

Aspects and advantages of the invention will be set forth in part in the following description, or may be obvious from the description, or may be learned through practice of the invention.

A coated compressor case is generally provided, along with methods of preparing a coated compressor case. In one embodiment, the coated compressor case comprises a compressor case having an inner surface, wherein the compressor case comprises a base material, and a coating system comprising a dense layer disposed along the inner surface of the compressor case, and an abradable top layer disposed along the dense layer, wherein the dense layer has a higher density than the abradable top layer.

In certain embodiments, the dense layer and the abradable top layer comprise aluminum silicon. In some embodiments, the coated compressor case further comprises a bond coat disposed between the inner surface of the compressor case and the dense layer, and in some embodiments, the bond coat comprises nickel aluminum.

In one embodiment, the dense layer has a density of about 2 $kg/m^3$ to about 2.7 $kg/m^3$, and in some embodiments, the density of the dense layer is about 20% to about 270% greater than the density of the abradable top layer. For instance, in some embodiments, the density of the dense layer is about 30% to about 250% greater than the density of the abradable top layer.

In certain embodiments, the coating system has a tensile strength of about 4000 psi to about 6200 psi, such as a tensile strength of about 4800 psi to about 5200 psi.

In some embodiments, the dense layer has an average thickness of from about 1 mil to about 8 mils, and in some embodiments, the compressor case is configured to be positioned in a turboshaft engine.

Aspects of the present disclosure are also directed to a gas turbine engine comprising: a compressor comprising a compressor case having an inner surface, wherein the compressor case comprises a base material, and a coating system disposed along the inner surface of the compressor case, wherein the coating system comprises a dense layer and an abradable, top coat, wherein the dense layer has a higher density than the abradable, top coat. In certain embodiments, the gas turbine engine is a turboshaft engine. In some embodiments, the base material comprises titanium.

Aspects of the present disclosure are also directed to methods of preparing a coated compressor case. In certain embodiments, the method comprises forming a dense layer along a surface of a base material of a compressor case, and forming a top coat along a surface of the dense layer. The method, in some embodiments, also comprises forming a bond coat along the surface of the base material of the compressor case. In certain embodiments, forming a dense layer comprises thermally spraying aluminum silicon with argon gas as a carrier gas, and may comprise thermally spraying aluminum silicon with argon gas as a carrier gas and with a plasma current of about 600 Amps. The method may further comprise applying hydrogen gas as a secondary carrier gas. In some embodiments, forming a top coat comprises thermally spraying aluminum silicon with nitrogen gas as a carrier gas and with a plasma current of about 275 Amps.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended FIGS., in which.

Figure 1:
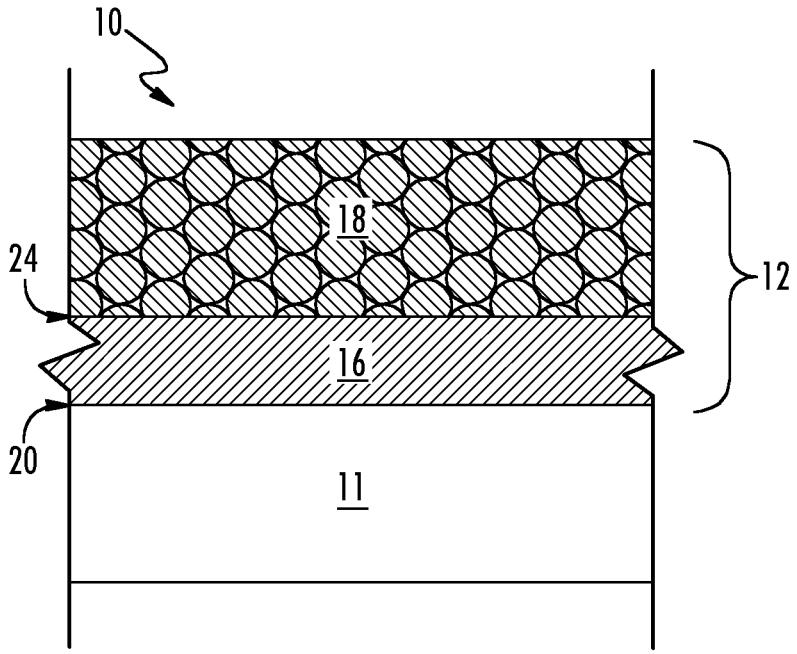
FIG. 1 is a schematic cross-sectional view of an exemplary compressor case comprising a coating system in accordance with one embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative direction with respect to fluid flow in a fluid pathway. For example, "upstream" refers to the direction from which the fluid flows, and "downstream" refers to the direction to which the fluid flows.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

A coating system for a compressor case is generally provided herein, along with methods of forming such coating system. The composition of the coating system and the methods of applying the coating system to the compressor case reduce galvanic corrosion of the coating system, thereby reducing spallation of the coating system and increasing the lifetime of the coating system and the compressor case. A high density/reduced porosity layer, which may be referred to herein as the "dense layer" is disposed along the compressor case and an abradable top coat may be disposed along the dense layer. Electrolytic solutions may enter the abradable top coat. However, the dense layer may act as a seal to prevent or reduce further egress of electrolytic solutions. Due to the chemical composition of the dense layer in comparison to the top coat, galvanic corrosion is unlikely to occur at the interface of these two layers. Since the dense layer blocks further egress of electrolytic solutions past the dense layer, galvanic corrosion between additional materials of the coating system or between the compressor case is reduced.

In addition to reducing the occurrence of galvanic corrosion and spallation, the coating system may provide an increase in the ultimate tensile strength of the coating providing a stronger and more durable coating system.

As used herein, "more dense" or "less porous" refers to the comparison of two layers. The "more dense" or "less porous" layer may be referred to as the "dense layer" and may have a density of about 2 to about 2.7 kg/m$^3$, such as about 2.1 to about 2.7 kg/m$^3$, about 2.2 to about 2.6 kg/m$^3$, about 2.3 to about 2.5 kg/m$^3$, or about 2.4 to about 2.5 kg/m$^3$. In certain embodiments, the dense layer may have a density of about 2 to about 2.7 kg/m$^3$, and the porous top coat may have a density of about 1 to about 2 kg/m$^3$, such as about 1.1 to about 1.9 kg/m$^3$, about 1.2 to about 1.8 kg/m$^3$, about 1.3 to about 1.7 kg/m$^3$, or about 1.4 to about 1.6 kg/m$^3$. In some embodiments, the density of the dense layer may be about 15% or more than the density of the porous top coat. For instance, in some embodiments, the density of the dense layer may be about 20% to about 270% greater than the porous top coat, such as about 30% to about 250%, about 35% to about 200%, about 50% to about 150%, or about 80% to about 100% greater than the porous top coat.

The coated compressor case can be utilized as a component for a gas turbine engine. In particular, the coated compressor case can be positioned within a gas flow path of a gas turbine engine such that the coating system protects the compressor case within the gas turbine engine when exposed to external fluids. The coating system may be particularly beneficial for maritime gas turbine engines where the engines often come in contact with external fluids such as salt water.

FIG. 1 shows an exemplary coating system 12 in accordance with one embodiment of the present disclosure. The coating system 12 is generally represented as being adapted for application to a compressor case within an aircraft gas turbine engine (illustrated in FIG. 3). FIG. 1 illustrates the cross section of a coated compressor 10 including a base material 11. The coating system 12 is disposed along a surface 20 of the base material 11. In the embodiment illustrated in FIG. 1, the coating system 12 includes a dense layer 16 disposed along a surface 20 of the base material 11 and a top coat 18 disposed along a surface 24 of the dense layer 16. As illustrated in FIG. 1, the top coat 18 is more porous than the dense layer 16. As explained herein, the dense layer 16 is prepared along the base material 11 such that the dense layer 16 has reduced porosity and may have substantially no pores in the layer. That is, the dense layer 16 is compact in comparison to the top coat 18.

As shown in FIG. 1, in this embodiment, the coating system 12 includes a single dense layer 16 and a single top coat 18. In certain embodiments, more than one dense layer 16, and/or top coat 18 may be used in the coating system 12. For instance, in some embodiments, multiple dense layers 16 or multiple top coats 18 may be used and may be disposed in various configurations so long as at least one dense layer 16 is disposed beneath at least one top coat 18. Various configurations of the present disclosure may be available without deviating from the intent of the present disclosure.

The base material 11 of the compressor 10 may comprise any suitable material for the compressor case, such as any suitable metal, metal alloy, or ceramic, and may comprise multiple layers of materials to form the compressor case base material 11. In some embodiments, the compressor case may comprise titanium, varieties of stainless steel, steel, or combinations thereof.

The dense layer 16 and the top coat 18 may comprise any suitable chemical composition so long as there is no substantial difference in galvanic potential between the two layers. As used herein, "no substantial difference" in galvanic potential refers to a difference of less than or equal to 0.25 V, such as less than or equal to 0.20 V, or less than or equal to 0.15 V. Without intending to be bound by theory, the reduced porosity dense layer 16 prevents further egress of external fluids through the coating system 12, preventing the accumulation of external fluids past the dense layer 16 and thereby preventing galvanic corrosion between the dense layer 16 and the compressor case or other coating material. In conventional coating systems, when external fluid accumulates beneath conventional top coats, the external fluid, such as salt water, create an environment for galvanic corrosion. In the present coating system 12, any external fluid resides at the surface 24 of the dense layer 16 rather than at the surface 20 of the base material 11 or at the surface of other coating material. Since the dense layer 16 and the top coat 18 have no substantial difference in galvanic potential at the interface of the dense layer 16 and the top coat 18, no galvanic corrosion occurs at the surface 24 of the dense layer 16. The reduction in galvanic corrosion results in reduced spallation of the coating system 12, thereby providing an increased lifetime of the coating system 12 and the compressor case.

The dense layer 16 and the top coat 18 may comprise any suitable material for coating the compressor case. The composition of the dense layer 16 and the top coat 18 may differ so long as the galvanic potential of the two layers is not substantially different. For instance, in some embodiments, the dense layer 16 and the top coat 18 both comprise aluminum silicon. The materials should also be such that the porosity of the layers can be modified so as to make a dense layer and a porous or abradable layer. Any metallic low-modulus abradable material whose porosity is not occupied by a filler material (e.g., polyester) may take advantage of the density variation.

The dense layer 16 and top coat 18 may be formed by any suitable process, such as plasma spray, physical vapor deposition (PVD), high velocity oxygen fuel (HVOF), electrostatic spray assisted vapor deposition (ESAVD), and direct vapor deposition. In certain embodiments, the dense layer 16 and/or the top coat 18 may be formed by plasma spray with any suitable carrier gas, such as nitrogen, argon, hydrogen, or combinations thereof. An increased density may be achieved with argon as the primary gas and hydrogen as a secondary gas. In addition, the presence of argon gas as the primary gas may also reduce the formation of oxide products of the melted particles resulting in a stronger coating system 12. In some embodiments, to achieve an increase in density for the dense layer 16, the plasma current may be between about 275 to about 600 Amps, such as about 550 to about 600 Amps, with argon as the carrier gas and hydrogen as a secondary gas. To form the top coat 18, the plasma current may be reduced to the settings of about 275 to about 550 Amps, such as about 275 to about 500 Amps or about 500 to about 550 Amps with nitrogen gas as the carrier gas (no hydrogen gas).

Figure 2:
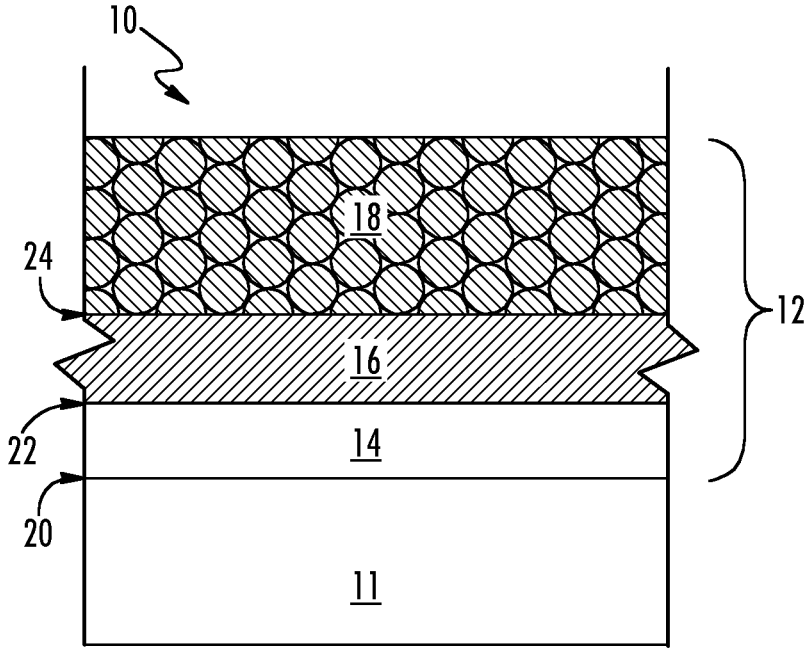
FIG. 2 is a schematic cross-sectional view of an exemplary compressor case comprising a coating system in accordance with one embodiment of the present disclosure.

FIG. 2 shows an exemplary coating system 12 in accordance with one embodiment of the present disclosure. The coating system 12 is generally represented as being adapted for application to a compressor case within an aircraft gas turbine engine (illustrated in FIG. 3). FIG. 2 illustrates the cross section of a coated compressor 10 including a base material 11. The coating system 12 is disposed along a surface 20 of the base material 11. In the embodiment illustrated in FIG. 2, the coating system 12 includes a bond coat 14 disposed along the surface 20 of the base material 10, a dense layer 16 disposed along a surface 22 of the bond coat 14, and a top coat 18 disposed along a surface 24 of the dense layer 16. As illustrated in FIG. 2, the top coat 18 is more porous than the dense layer 16. As explained herein, the dense layer 16 is prepared along the bond coat 14 such that the dense layer 16 has reduced porosity and may have substantially no pores in the layer. That is, the dense layer 16 is compact in comparison to the top coat 18.

As shown in FIG. 2, in this embodiment, the coating system 12 includes a single bond coat 14, a single dense layer 16, and a single top coat 18. In certain embodiments, more than one bond coat 14, dense layer 16, and/or top coat 18 may be used in the coating system 12. For instance, in some embodiments, multiple dense layers 16 or multiple top coats 18 may be used and may be disposed in various configurations such as a dense layer 16 over a top coat 18 followed by another top coat 18. Various configurations of the present disclosure may be available without deviating from the intent of the present disclosure.

The bond coat 14 may comprise any suitable material, such as any suitable plastic, metal, metal alloy, or ceramic, and may comprise multiple layers of materials to form the bond coat 14. In certain embodiments, the bond coat 14 improves adherence of the dense layer 16 and/or top coat 18 to the base material 11. In certain embodiments, the bond coat 14 comprises nickel aluminum (NiAl). The bond coat 14 may be disposed along the surface of the base material 11 of the compressor 10 by any suitable method such as air-plasma spray (APS), physical vapor deposition (PVD), high velocity oxygen fuel (HVOF), electrostatic spray assisted vapor deposition (ESAVD), and direct vapor deposition.

Without intending to be bound by theory, the reduced porosity dense layer 16 prevents further egress of external fluids through the coating system 12, preventing the accumulation of external fluids between the bond coat 14 and the dense layer 16 or top coat 18. The coating system 12 thereby prevents galvanic corrosion at the surface of the bond coat 14. In conventional coating systems, when external fluid accumulates beneath conventional top coats, the external fluid, such as salt water, create an environment for galvanic corrosion. For instance, with a bond coat 14 of nickel aluminum (NiAl) and a top coat 18 of aluminum silicon (AlSi), a galvanic potential difference of about 0.7 V exists. When an electrolytic solution, such as salt water, is present, galvanic corrosion of the coating may occur.

In the present coating system 12, any external fluid resides at the surface 24 of the dense layer 16 rather than at the surface 22 of the top coat 14 or at the surface of other coating material. Since the dense layer 16 and the top coat 18 have no substantial difference in galvanic potential at the interface of the dense layer 16 and the top coat 18, no galvanic corrosion occurs at the surface 24 of the dense layer 16. The reduction in galvanic corrosion results in reduced spallation of the coating system 12, thereby providing an increased lifetime of the coating system 12 and the compressor case.

The coating system 12 has an increased tensile strength compared to conventional coatings for compressor cases. When forming the dense layer 16 by the plasma spray technique, the layer may comprise a reduced amount of unmelted particles and an increased number of "splats" formed by flattening of liquid droplets. The method of applying the dense layer 16 to the base material 11 (see e.g., FIG. 1), to the bond coat 14 (see e.g., FIG. 2), or other coating material is such that the layer formed by the plasma spray may comprise partially melted and unmelted particles with the amount of unmelted particles reduced to a minimum. The splats are able to fill in irregular peaks and valleys of the base material 11, bond coat 14, or other coating material. With a higher concentration of splats, the surface area of contact with the underlying layer/material increases resulting in a stronger bond of the dense layer 16 and the underlying layer/material. The coating system 12 thus has an increased tensile strength.

For instance, the tensile strength of the coating system 12 may increase from about 3000 psi to about 5100 psi with the incorporation of the dense layer 16. For instance, the tensile strength of the coating system 12 may be greater than about 3000 psi, such as from about 3000 psi to about 7000 psi, from about 4000 psi to about 6200 psi, about 4500 psi to about 6000 psi, about 4600 psi to about 5500 psi, about 4800 psi to about 5200 psi. The coating system 12 may have an ultimate tensile strength of greater than or equal to about 3200 psi, about 3300 psi, about 3400 psi, about 3500 psi, about 3600 psi, about 3700 psi, about 3800 psi, about 3900 psi, about 4000 psi, about 4100 psi, about 4200 psi, about 4300 psi, about 4400 psi, about 4500 psi, about 4600 psi, about 4700 psi, about 4800 psi, about 4900 psi, about 5000 psi, about 5100 psi, about 5200 psi, about 5300 psi, about 5400 psi, about 5500 psi, about 5600 psi, about 5700 psi, about 5800 psi, about 5900 psi, about 6000 psi, about 6100 psi, or about 6200 psi. The coating system 12 thereby provides an improved coating for a compressor case with increased lifetime and strength while maintaining abradability.

Further, in certain embodiments, the dense layer 16 and the top coat 18 may have the same chemical composition. Thus, the coating system 12 can be incorporated into current processes more readily since the chemical composition of the coatings is not changed.

The thickness of the bond coat 14 may range from about 1 to about 10 mils thick, such as from about 2 mils to about 9 mils thick, about 3 mils to about 8 mils thick, about 4 mils to about 7 mils thick, or about 5 mils to about 6 mils thick. The thickness of the dense layer 16 may range from about 1 to about 20 mils thick, such as from about 2 mils to about 10 mils thick, about 3 mils to about 8 mils thick, about 4 mils to about 7 mils thick, or about 5 mils to about 6 mils thick. In certain embodiments, the thickness of the dense layer 16 is greater than about 1 mil thick and less than about 8 mils thick. The top coat 18 may be about 15 to about 60 mils thick before or after being machined down, such as about 35 mils to about 55 mils thick, about 40 mils to about 50 mils thick, or about 45 mils to about 50 mils thick. The benefits of the dense layer 16 may be achieved with a relatively thin layer compared to the adjoining top coat 18.

Figure 3:
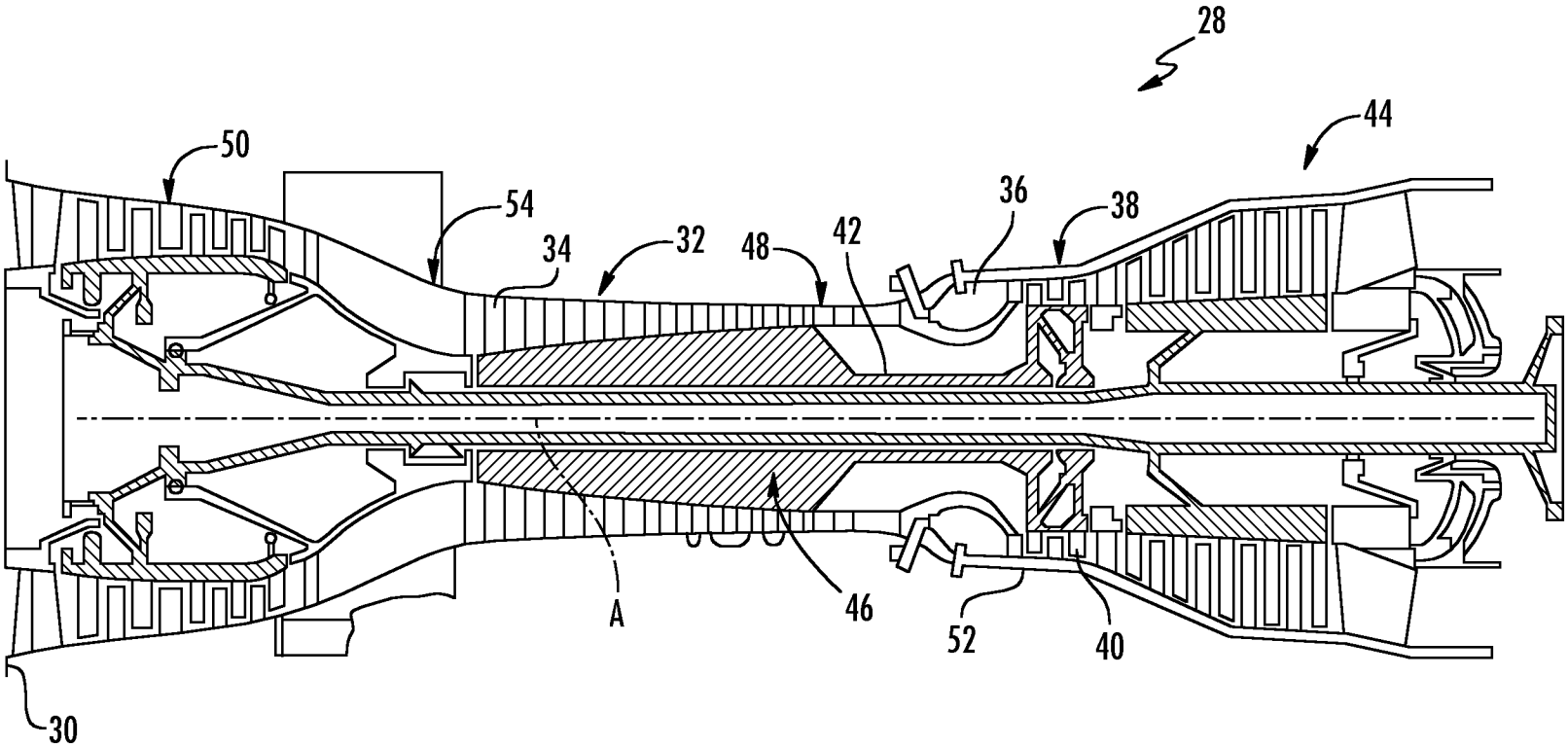
FIG. 3 is a schematic cross-sectional view of a gas turbine engine in accordance with one embodiment of the present disclosure.

FIG. 3 is a cross-sectional view of a turboshaft engine in accordance with embodiments of the present disclosure. In this embodiment, the gas turbine engine 28 includes an inlet 30, a high pressure compressor ("HPC") 32 carrying a number of stages of rotating compressor blades 34, a combustor 36, and a high pressure turbine ("HPT") 38 carrying a number of stages of rotating turbine blades 40. The HPC, combustor, and HPT are all arranged in a serial, axial flow relationship along a central longitudinal axis denoted by line "A." Collectively these three components are referred to as a "core." The high pressure compressor 32 provides compressed air that passes into the combustor 36 where fuel is introduced and burned, generating hot combustion gases. The hot combustion gases are discharged to the high pressure turbine 38 where they are expanded to extract energy therefrom. The high pressure turbine 38 drives the compressor 32 through a rotor shaft 42. Combustion gases exiting from the high pressure turbine 38 are discharged to a downstream power turbine 44 (also sometimes referred to as a "low pressure turbine" or "work turbine").

Collectively the high pressure compressor 32, the rotor shaft 42, and the high pressure turbine 38 are referred to as a "core rotor" or simply a "rotor" 46. The rotor 46 rotates within a stationary annular casing 48, which in this example includes a high pressure compressor case 50 and a compressor rear frame 52. The radial tips of the compressor blades 34 and the turbine blades 40 have defined radial clearances from the inner surface of the casing 48.

While not shown in FIG. 2, the compressor case 50 may be coated with the coating system 12 as disclosed above. In particular, the inner surface 54 of the compressor case 50 may be coated with a coating system 12 including a dense layer 16 and a top coat 18. In certain embodiments, the coating system 12 may include one or more layers of a bond coat 14, dense layer 16, and top coat 18 in various arrangements. In certain embodiments, the coating system 12 includes as least one dense layer 16 between a bond coat 14 and a top coat 18.

While the present disclosure is described with respect to a turboshaft engine, the disclosed embodiments may be applied to turbomachinery in general, including turbojet, turboprop and turbofan gas turbine engines, including industrial and marine gas turbine engines and auxiliary power units.

Figure 4:
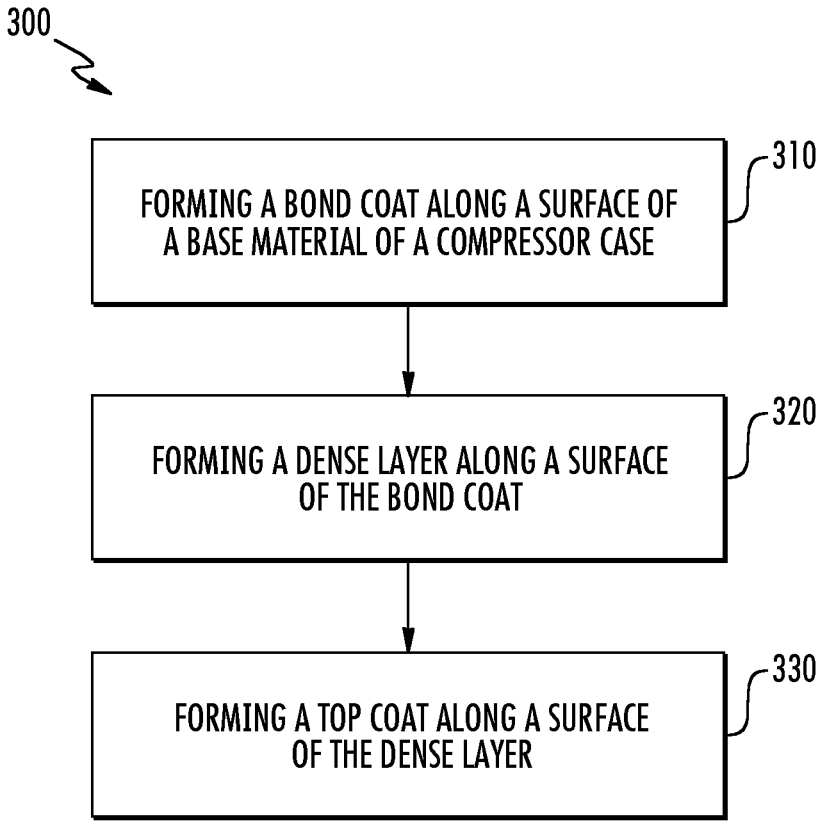
FIG. 4 is a flowchart of a method of preparing a compressor case comprising a coating system in accordance with one embodiment disclosed herein.

FIG. 4 is a flowchart of a method of preparing a compressor case comprising a coating system in accordance with one embodiment disclosed herein. In the embodiment illustrated in FIG. 4, the method 300 comprises forming a bond coat on a surface of a base material of a compressor case 310, forming a dense layer on a surface of the bond coat 320, and forming a top coat on a surface of the dense layer 330. The bond coat, dense layer, and top coat may be formed by any suitable process, such as the processes described herein. For instance, the dense layer may be formed by the plasma spray technique using argon gas and hydrogen gas with plasma currents described herein. The top coat may also be formed using nitrogen gas with plasma currents described herein. After forming the coating system on the compressor case, the compressor case may be processed using conventional techniques such as machining the coating to the desired thickness and incorporating other elements of the compressor into the compressor case.

While the present application is discussed in relation to compressor cases, the disclosure may be applied in other applications such as where the porosity of the coating can be modified to provide a physical barrier to electrolytic solutions. For instance, the present disclosure may be applied in other applications using abradable coatings. The increase in density of one layer verse another layer formed of materials with substantially no difference in galvanic potential can move the interface where electrolytic solutions may reside such that the occurrence of galvanic corrosion is significantly reduced. The disclosure can also be extended to other applications where an increase in tensile strength of the coating would be beneficial. Application of a coating system in accordance with the present disclosure may provide a coating system with increased surface area of contact between adjoining layers resulting in an increase in tensile strength.

EXAMPLES

Cross-sectional images of conventional coating systems for a compressor case were analyzed, which showed a bond coat disposed over a compressor case and a top coat disposed over the bond coat. Delamination of the coating occurs due to galvanic corrosion at the interface of the bond coat and the top coat. The coatings were prepared using a case spinning at 250 RPM with the plasma nozzle tracks parallel to the sprayed surface. The cases are titanium and the bond coats comprise nickel aluminum. The top coats include aluminum silicon. The bond coats were prepared with 8 loops (16 passes) where a loop is defined by spraying from the top (e.g., "Stage 1") to the bottom (e.g., "Stage 5") and then back from the bottom to the top. The top coats were prepared with 32 loops (64 passes) and are shown premachined. The thicknesses of the bond coats are about 0.003 to about 0.005 in. and about 0.002 to about 0.004 in.

Images of the delamination of conventional coating systems for a compressor case were analyzed. In particular, the growth and spacing of delamination sites were reviewed along a compressor case coated with a conventional coating system. The growth of delamination sites were also reviewed with a conventional coating system on a compressor case. Without intending to be bound by theory, it is thought that the growth of the delamination sites starts with normal displacement of the top coat centered at a nucleation site and then proceeds to normal and radial crack growth stemming from the nucleation site, abrasion with blisk tips, liberation into the flow path, secondary rubbing on the case, and then aggravated delamination. Images of the delamination of conventional coating systems on compressor cases were also reviewed.

A coating system was made in accordance with one embodiment of the present disclosure. The coating system included a bond coat, a dense layer, and a top coat. The dense layer is more dense than the top coat as shown by the porous nature of the top coat in comparison to the dense layer. The coating system was prepared with a titanium coupon, a nickel aluminum bond coat, and an aluminum silicon dense layer and top coat. The bond coat was prepared with 8 loops (16 passes).

Another coating system was made on a test coupon in accordance with one embodiment of the present disclosure. The dense layer is more compact than the top, porous layer. The test coupon was titanium and was prepared with 36 G aluminum oxide at 60 psig. The nozzle was 5 (in) from the coupon and was sprayed within two hours from surface preparation. The dense layer was prepared with 5 loops (about 0.010 to about 0.015 in.). The dense layer was prepared with argon gas as the carrier gas and a plasma current of about 600 Amps. The top coat was prepared with nitrogen gas and a plasma current of about 275 Amps. The coating system was prepared with a nickel aluminum bond coat, and an aluminum silicon dense layer and top coat.

Another coating system was made on a test coupon in accordance with one embodiment of the present disclosure. The dense layer is more compact than the top, porous layer. The test coupon was titanium and was prepared with 36 G aluminum oxide at 60 psig. The nozzle was 5 (in) from the coupon and was sprayed within two hours from surface preparation. The dense layer was prepared with 5 loops. The dense layer was prepared with argon gas as the carrier gas and a plasma current of about 600 Amps. The top coat was prepared with nitrogen gas and a plasma current of about 275 Amps. The coating system was prepared with a nickel aluminum bond coat, and an aluminum silicon dense layer and top coat.

Figure 5:
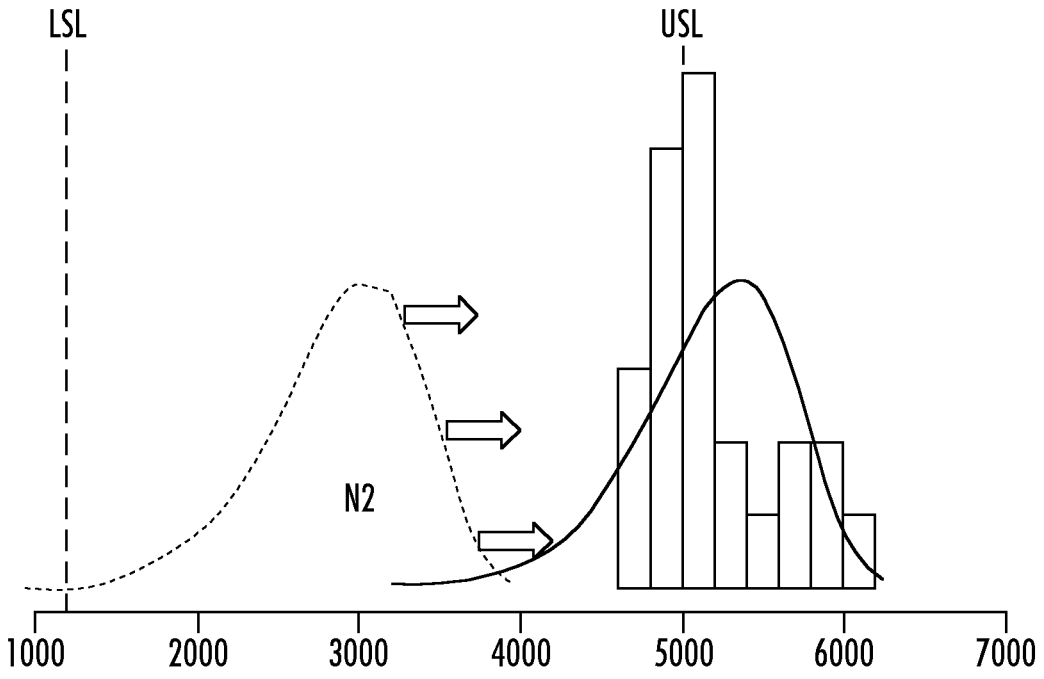
FIG. 5 illustrates the increase in ultimate tensile strength seen in the coating system in accordance with one embodiment of the present disclosure.

FIG. 5 illustrates the increase in ultimate tensile strength seen in the coating system in accordance with one embodiment of the present disclosure. The tensile strength of the coating system was measured at various points along test coupons. The test coupons were 1 in. diameter stainless steel buttons sprayed with an aluminum silicon dense layer.

Test coupons were also tested against coupons mounted in the flowpath of a compressor case using a scrap titanium compressor case (referred to as the "destructive test"). The test was to determine whether the test coupons where representative (metallographic) of coupons mounted in the flowpath. An image of the scrap titanium compressor case coupons was used to compare the test coupons to coupons mounted in the flowpath of a compressor case.

Cross-sectional views of a coated scrap titanium compressor case were reviewed, along with cross-sectional views of thin titanium coupons tack welded into a scrap titanium compressor case at specific compressor stages. The coupons were prepared with a conventional coating. A nickel aluminum bond coat was used and, where applicable, an aluminum silicon dense layer and top coat were used. The layers were applied by plasma spray.

The compressor case destructive test was inconclusive due to difficulties encountered with metallographic mounting. The coating system appeared to be leaching oil/water during vacuum application. There was also poor infiltration of epoxy matrix into the coating microstructure causing smearing and local collapse/fill of the top coat porosity. This smearing/smudging gave a false impression of high coating density throughout. The extreme thickness of the compressor case cross section may have also contributed to poor polish appearance.

However, the metallographic results showed that the conventionally coated coupons had good correlation with coupons mounted within the flowpath and the argon/dense layer metallographic had good correlation with coupons mounted within the flowpath.

The coupons were prepared with 36 G aluminum oxide at 60 psig. The nozzle was 5 (in) from the coupon and was sprayed within two hours from surface preparation. The dense layer, when applicable, was prepared with 5 loops. The dense layer was prepared with argon gas as the carrier gas and a plasma current of about 600 Amps. The top coat, when used with the dense layer, was prepared with nitrogen gas and a plasma current of about 275 Amps. Otherwise, the top coat was prepared with nitrogen gas and a plasma current of about 450 Amps.

Figure 6:
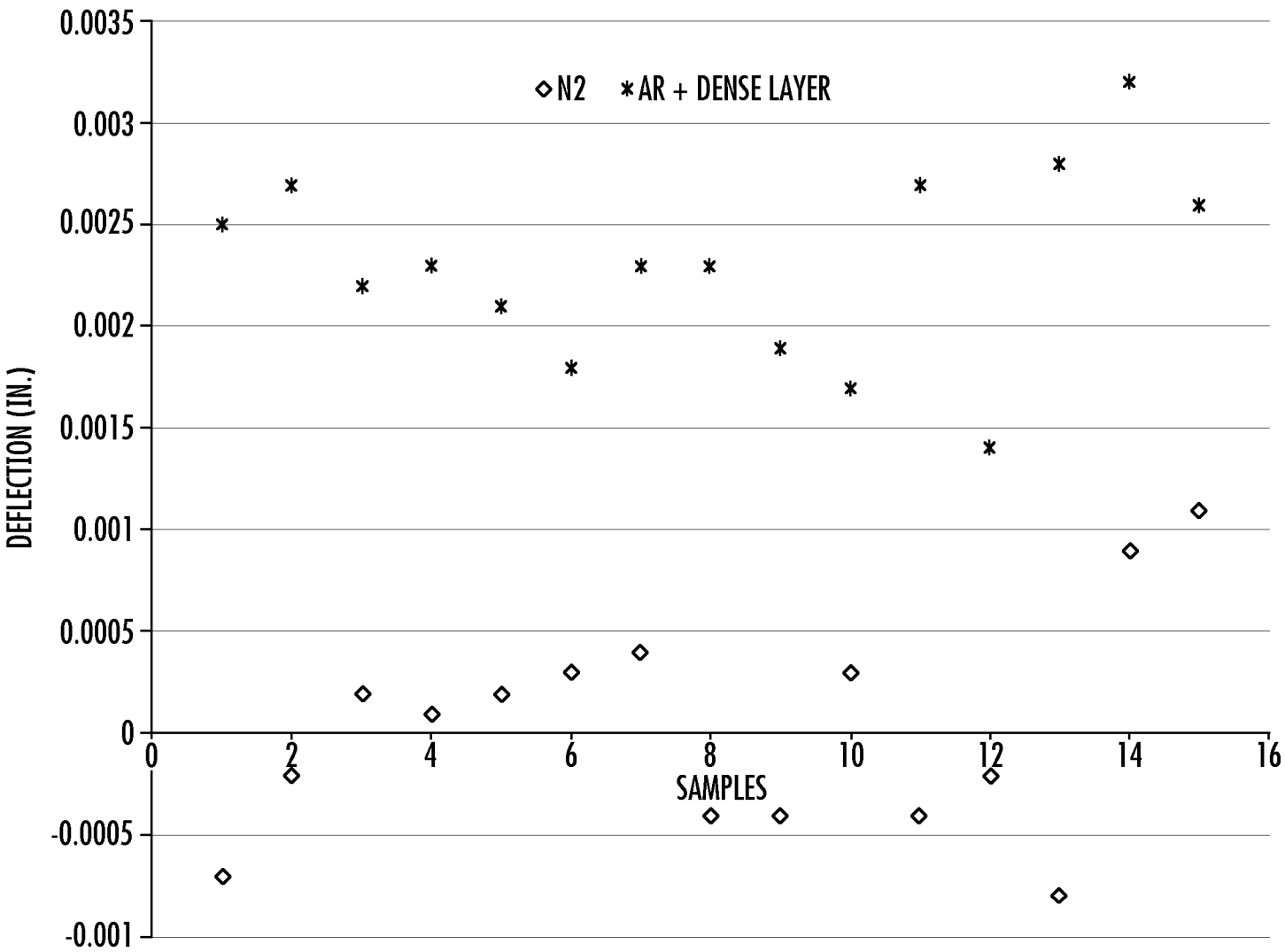
FIG. 6 illustrates a plot of the Alman testing of test coupons prepared with a coating system in accordance with one example of the present disclosure.

An Alman testing of test coupons were prepared with a coating system in accordance with one embodiment of the present disclosure. The testing was used to determine in-plane stress comparisons between coupons. The Alman test provides an indirect determination by aiding in ranking relative stress states due to static deflections of coupons. The method used strips of less than 0.0002 inches. The coupons were rinsed with acetone and prepped with 36 G aluminum oxide. Thirty coupons were tested—15 with conventional coating systems and 15 with a dense layer formed by plasma spray technique with argon gas. The dense layer comprised aluminum silicon. FIG. 6 plots the deflection of each test coupon.

The Almen testing indicated that there is a slight increase in in-plane stresses due to the dense layer. The conventional test coupons had an average deflection of 0.00002 in. and the test coupons with the dense layer had an average deflection of about 0.0023 in. The accuracy of the Almen gage is +/−0.0002 inches (+tension and −compression in-plane). Considering the thickness of the coating system, the slight increase in in-plane stress is a manageable side effect. A slight increase in shot-peening may be needed during A-B-C restoration during flowpath recoat.

While the invention has been described in terms of one or more particular embodiments, it is apparent that other forms could be adopted by one skilled in the art. It is to be understood that the use of "comprising" in conjunction with the coating compositions described herein specifically discloses and includes the embodiments wherein the coating compositions "consist essentially of" the named components (i.e., contain the named components and no other components that significantly adversely affect the basic and novel features disclosed), and embodiments wherein the coating compositions "consist of" the named components (i.e., contain only the named components except for contaminants which are naturally and inevitably present in each of the named components).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas turbine engine comprising:

a compressor comprising a compressor case having an inner surface, wherein the compressor case comprises a base material, wherein the base material comprises titanium; and a coating system disposed over the inner surface of the compressor case, wherein the coating system comprises:

a bond coat over the inner surface of the compressor case, wherein the bond coat comprises nickel aluminum;

a dense layer comprising a dense layer material over the bond coat, wherein the dense layer material comprises aluminum silicon, wherein the dense layer has an average thickness of from 1 mil to 8 mils; and an abradable top coat comprising an abradable top coat material over the dense layer, wherein the abradable top layer material comprises aluminum silicon, and wherein the dense layer has a higher density than the abradable top coat, and further wherein the dense layer and the abradable top layer have no substantial difference in galvanic potential.

2. The gas turbine engine according to claim 1, wherein the dense layer has a density of 2 $kg/m^3$ to 2.7 $kg/m^3$.

3. The gas turbine engine according to claim 1, wherein the density of the dense layer is 20% to 270% greater than the density of the abradable top layer.

4. The gas turbine engine according to claim 1, wherein the density of the dense layer is 30% to 250% greater than the density of the abradable top layer.

5. The gas turbine engine according to claim 1, wherein the coating system has a tensile strength of 4000 psi to 6200 psi.

6. The gas turbine engine according to claim 1, wherein the coating system has a tensile strength of 4800 psi to 5200 psi.

7. The gas turbine engine according to claim 1, wherein the gas turbine engine is a turboshaft engine.

8. The gas turbine engine according to claim 1, wherein the dense layer material and the abradable top layer material comprise the same chemical composition.

9. The gas turbine engine according to claim 1, wherein the dense layer material and the abradable top layer material comprise different chemical compositions.

10. A method of preparing a coated compressor case of a gas turbine engine, the method comprising:

forming a bond coat over an inner surface of a base material of a compressor case, wherein the base material comprises titanium, and wherein the bond coat comprises nickel aluminum;

forming a dense layer over the bond coat, wherein the dense layer comprises a dense layer material, wherein the dense layer material comprises aluminum silicon, wherein the dense layer has an average thickness of from 1 mil to 8 mils; and forming an abradable top coat over a surface of the dense layer, wherein the abradable top coat comprises an abradable top coat material, wherein the abradable top layer material comprises aluminum silicon, and wherein the dense layer has a higher density than the abradable top coat.

11. The method according to claim 10, wherein forming the dense layer comprises thermally spraying aluminum silicon with argon gas as a carrier gas.

12. The method according to claim 10, wherein forming the dense layer comprises thermally spraying aluminum silicon with argon gas as a carrier gas and with a plasma current of 600 Amps.

13. The method according to claim 12, further comprising applying hydrogen gas as a secondary carrier gas.

14. The method according to claim 10, wherein forming the top coat comprises thermally spraying aluminum silicon with nitrogen gas as a carrier gas and with a plasma current of 275 Amps.

* * * * *